United States Patent [19]

Isoda et al.

[11] Patent Number: 4,672,016

[45] Date of Patent: Jun. 9, 1987

[54] CARRIER PARTICLES FOR USE IN A DEVELOPER FOR DEVELOPING LATENT ELECTROSTATIC IMAGES COMPRISE ORGANIC TIN COMPOUND, SILICONE RESIN AND CONDUCTIVE MATERIAL

[75] Inventors: Tetsuo Isoda, Numazu; Youichirou Watanabe, Fuji; Mitsuo Aoki; Nobuhiro Nakayama, both of Numazu, all of Japan

[73] Assignee: Ricoh Company, Ltd., Tokyo, Japan

[21] Appl. No.: 837,139

[22] Filed: Mar. 7, 1986

[30] Foreign Application Priority Data

Mar. 8, 1985 [JP] Japan ..... 60-044563

[51] Int. Cl.[4] ..... G03G 9/10

[52] U.S. Cl. ..... 430/108; 428/407

[58] Field of Search ..... 430/108; 428/407

[56] References Cited

U.S. PATENT DOCUMENTS 3,526,533 9/1970 Jacknow et al. ..... 430/403
3,672,928 6/1972 Madrid et al. ..... 430/48
3,998,634 12/1976 Iwasa ..... 430/45 X

*Primary Examiner*—J. David Welsh
*Attorney, Agent, or Firm*—Oblon, Fisher, Spivak, McClelland & Maier

[57] ABSTRACT

Carrier particles for use in a two-component dry-type developer for developing latent electrostatic images comprising a core particle and a silicone resin layer coated on the core particle, the silicone resin layer comprising a silicone resin, an organic tin compound and finely-divided electroconductive particles.

13 Claims, 4 Drawing Figures

CARRIER PARTICLES FOR USE IN A DEVELOPER FOR DEVELOPING LATENT ELECTROSTATIC IMAGES COMPRISE ORGANIC TIN COMPOUND, SILICONE RESIN AND CONDUCTIVE MATERIAL

BACKGROUND OF THE INVENTION

The present invention relates to carrier particles of a two-component dry-type developer for developing latent electrostatic images to visible images for use in electrophotography, electrostatic recording methods and electrostatic printing methods. More particularly, it relates to carrier particles coated with a silicone resin layer comprising a silicone resin, an organic tin compound and finely-divided electroconductive particles.

Conventionally, as the methods for developing latent electrostatic images with toner, for example, a cascade development method (U.S. Pat. No. 2,618,552) and a magnetic brush development method (U.S. Pat. No. 2,874,063) are known. In either method, a two-component developer is employed, which comprises carrier particles and toner particles, and the toner particles are usually much smaller than the carrier particles and are triboelectrically attracted to the carrier particles and are held on the surface thereof. The electric attraction between the toner particles and the carrier particles is caused by the friction between the toner particles and the carrier particles. When the toner particles held on the carrier particles are brought near or into contact with a latent electrostatic image, the electric field of the latent electrostatic image works on the toner particles to separate the toner particles from the carrier particles, overcoming the bonding force between the toner particles and the carrier particles. As a result, the toner particles are attracted towards the latent electrostatic image, so that the latent electrostatic image is developed to a visible toner image. In this case, it is necessary that the toner particles be charged with an appropriate polarity and with an exact amount of electric charge, so that the toner particles are preferentially and exactly attracted to the desired areas to be developed on the photoconductor.

In a conventional two-component type developer, it is apt to occur that the surface of the carrier particles is eventually covered with the toner particles to form a toner film layer on the carrier particles in the course of the mechanical mixing of the toner particles with the carrier particles in the development apparatus. Once this phenomenon takes place, which is generally referred to as the "spent phenomenon", the toner particles gradually accumulate on the carrier particles, so that the triboelectric charging between the carrier particles and the toner particles is replaced by the triboelectric charging among the toner particles. In the end, the triboelectric charging characteristics of the developer significantly deteriorate, so that a considerable amount of the toner particles are deposited on the background of the copy images. As a matter of course, when this occurs, the copy quality is considerably degraded. In the end, it is necessary to replace the entire developer by a new developer.

In order to prevent the spent phenomenon, a method of coating the surface of carrier particles with a variety of resins has been proposed. However, resins capable of satisfactorily preventing the spent phenomenon have not been discovered. At one extreme, for instance, carrier particles coated with a styrene - methacrylate copolymer or polystyrene are excellent in the triboelectric charging properties. However, the surface energy of such carrier particles is comparatively so high that the carrier particles are easily covered with the toner particles while in use. In other words, the spent phenomenon occurs easily and, accordingly, the life of such developer is short.

The above-mentioned "spent phenomenon", is greatly reduced with carriers coated with a polytetrafluoroethylene polymer, since such carriers have a low surface energy. However, since the polytetrafluoroethylene polymer is positioned on the extreme negative side in the triboelectric series, the carriers coated with the polytetrafluoroethylene polymer cannot be employed when toner particles must be charged to a negative polarity.

In order to eliminate the above shortcomings, it has been proposed to coat the carrier particles with a material having a low surface energy, for example, with a silicone resin as proposed in Japanese Patent Publication No. 44-27879 and Japanese Laid-Open Patent Application No. 50-2543. In this method, the deposition of the toner particles on the carrier particles can be prevented. However, the silicone resin easily wears away and lacks mechanical strength. Therefore, when the carrier particles coated with silicone resin are used for continuous copying over an extended period of time, the core materials of the carrier particles are exposed since the silicone resin layer wears away by the collision among the carrier particles themselves and between the carrier particles and the mechanical parts of the development apparatus. As a result, the triboelectric charging between the toner particles and the silicone resin is eventually replaced by the triboelectric charging between the toner particles and the core materials of the carrier particles. Once this takes place, the triboelectric characteristics of the developer cannot be maintained constantly. Accordingly the copy image quality is significantly degraded. Further, since most of the resins for use in coating the carrier particles have high electric resistivity, when carrier particles coated with such resins are used in the developer, problems such as edge development, a significant decrease in image density and no image formation could occur.

Such coated carrier particles can be improved by decreasing the electric resistance of the coated layer of the carrier particles, for instance, by dispersing an electroconductive material in the coated layer of the carrier particles.

More specifically, when the carrier particles are provided with a certain electroconductivity, the carrier particles work as a development electrode, so that development of latent electrostatic images can be carried out as if development electrodes were positioned in close contact with the electrophotographic photoconductor. The result is that not only line images, but also solid images can be reproduced faithfully to the original images.

Conventionally, as such electroconductive materials for use in the coated layer of the carrier particles, for example, carbon and tin oxide are employed. However, when such electroconductive materials are employed in the coated layer of the carrier particles, the electric resistivity of the carrier particles is so decreased that the electric charge generated in the toner particles leaks through the carrier particles which are in contact with the toner particles, so that the toner particles cannot maintain a predetermined necessary amount of electric charge for development.

In order to develop latent electrostatic images formed on a photoconductor with a toner, the toner must maintain a predetermined quantity of electric charge. It is generally said that the quantity of electric charge ranging from 10 $\mu C/g$ to 20 $\mu C/g$ is suitable, since when the electric charge quantity is less than 10 $\mu C/g$, fogging appears in the developed images or the developer is caused to scatter from the development apparatus. On the other hand, when the electric charge quantity is more than 20 $\mu C/g$, an image density which is sufficiently high for faithful reproduction of original images cannot be obtained.

When the electric resistivity of the carrier particles is decreased, the quantity of electric charge that can be generated in the toner particles also decreases. When carrier particles with an electroconductive material dispersed therein are employed, it is necessary to appropriately adjust the quantity of electric charge to be generated in the toner. In order to do this, a charge controlling agent, for instance, a dye conventionally employed as charge control agent, is added to the toner, by dissolving such a dye in a solvent together with a resin component of the toner, or by kneading the dye together with a resin component of the toner.

Dyes employed as such charge controlling agent are generally expensive, and when a small amount of the dye is employed, it does not work effectively as charge controlling agent, while when a large amount of the dye is employed in order to increase the electric charge quantity, it becomes extremely difficult to uniformly disperse the dye throughout the resin and when such a toner is employed for an extended period of time, the development characteristics are significantly degraded while in use and high image quality cannot be obtained in a stable manner.

SUMMARY OF THE INVENTION

It is therefore an object of the present invention to provide carrier particles for use in a two-component dry-type developer for developing latent electrostatic images to visible toner images, which carrier particles are capable of retaining high charging performance and are not eventually subjected to the spent phenomenon while in use. Thus the developers using the carrier particles according to the present invention are capable of yielding high quality developed images without deterioration for an extended period of time.

The above object of the present invention is attained by the carrier particles coated with a silicone resin layer comprising a silicone resin, an organic tin compound and finely-divided electroconductive particles.

DETAILED DESCRIPTION OF THE PREFERRED EMBODIMENTS

Figure 1:
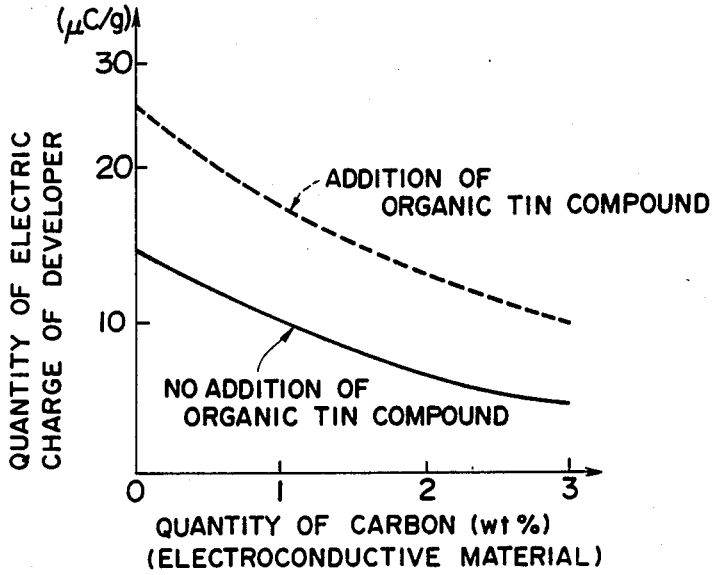
FIG. 1 is a graph showing the relationship between the quantity of carbon added as an electroconductive material and the quantity of electric charge of a developer.

Examples of a silicone resin for use in the silicone resin layer of the carrier particles according to the present invention are as follows:

(1) Silicone varnishes, for example, TSR 115, TSR 114, TSR 102, TRS 103, YR 3061, TSR 110, TSR 116, TSR 117, TSR 108, TSR 109, TSR 180, TSR 181, TSR 187, TSR 144 and TSR 165 (manufactured by Toshiba); and KR 271, KR 272, KR 275, KR 280, KR 282, KR 267, KR 269, KR 211 and KR 212 (manufactured by Shinetsu Silicone Co., Ltd.), (2) Alkyd-modified silicone varnishes, for example, TSR 184 and TSR 185 (manufactured by Tohiba), (3) Epoxy-modified silicone varnishes, for example, TSR 194 and YS 54 (manufactued by Toshiba)

(4) Polyester-modified silicone varnishes, for example, TSR 187 (manufactured by Toshiba), (5) Acryl-modified silicone varnishes, for example, TSR 170 and TRS 171 (manufactured by Toshiba)

(6) Urethane-modified silicone varnishes, for example, TSR 175 (manufactured by Toshiba), and (7) Reactive silicone varnishes, for example, KA 1008, KBE 1003, KBC 1003, KBM 303, KBM 403, KBM 503, KBM 602 and KBM 603 (manufactured by Shinetsu Silicone Co., Ltd.)

Examples of an organic tin compound for use in the present invention are as follows:

No. 1 $R_2^1Sn(OCOR^2)_2$ wherein $R^1$ and $R^2$ each represent an alkyl group having 1 to 10 carbon atoms.

No. 2 $(H_3C(CH_2)_3)_2Sn(OOC(CH_2)_{10}CH_3)_2$

No. 3

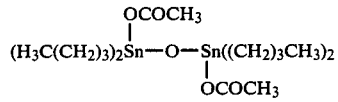

No. 4

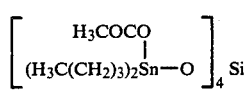

No. 5 $(CH_3(CH_2)_3)_2Sn(OCH_3)_2$

No. 6

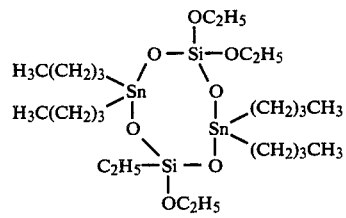

No. 7

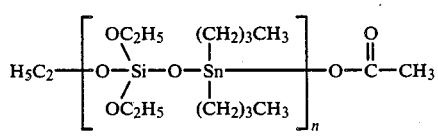

No. 8 $Sn(OCOR)_4$ wherein R represents an alkyl group having 1 to 10 carbon atoms.

In the present invention, by changing the amount of the organic tin compound employed in the silicone resin coated layer of the carrier particles, the quantity of electric charge that can be generated in the toner can be easily adjusted as desired, with the desired polarity. Further, since the silicone resins for use in the present invention include silanol groups (—SiOH) prior to the hardening thereof by application of heat, it is considered that the above organic tin compounds also serve as hardening catalyst for the silicone resins.

Examples of the electroconductive material for use in the present invention are organic materials, for example, carbon black such as furnace black, acetylene black and channel black; and inorganic materials, for example, borides, carbides, nitrides, oxides and silicides.

a. Examples of borides:
chromium boride, hafnium boride, molybdenum boride, niobium boride, tantalum boride, titanium boride and zirconium boride.

b. Examples of carbides:
boron carbide, hafnium carbide, molybdenum carbide, niobium carbide, silicon carbide, thallium carbide, titanium carbide, uranium carbide, vanadium carbide, tungsten carbide and zirconium carbide.

c. Examples of nitrides:
boron nitride, niobium nitride, thallium nitride, titanium nitride, vanadium nitride and zirconium nitride.

d. Examples of oxides:
chromium oxide, lead oxide, tin oxide, vanadium oxide, molybdenum oxide, bismuth oxide, iron oxide ($Fe_3O_4$), niobium oxide, osmium oxide, platinum oxide, rhenium oxide, ruthenium oxide, titanium oxide and tungsten oxide.

e. Examples of silicides:
molybdenum silicide, niobium silicide, thallium silicide, titanium silicide, vanadium silicide and tungsten silicide.

The above compounds have specific volume resistivities of $10^{-1}$ Ωcm or less and are representative materials suitable for use in the present invention. In particular, they are effective for adjusting the electric resistivity of the silicone resin layer by use of a small amount thereof.

It is preferable that the particle size of these compounds be 1 μm or less, more preferably 0.5 μm or less. Further, it is preferable that the amount of the above compounds be in the range of 1 wt. % to 50 wt. %, more preferably in the range of 2 wt. % to 30 wt. %, to the entire weight of the coating layer resin of the carrier particles according to the present invention.

For preparation of silicone resin coated carrier particles according to the present invention, the above-mentioned silicone resin, the organic tin compound and the electroconductive material are well dispersed in an appropriate organic solvent in a homogenizer to prepare a coating liquid, followed by coating the core particles with the coating liquid by immersing the core particles in the coating liquid, by spraying the coating liquid on the core particles or by a fluidized bed process.

As the organic solvent for dispersing the silicone resin, the organic tin compound and the electroconductive material, any solvents can be employed as long as the silicone resin can be dissolved therein. Specific examples of such solvents are alcohols such as methanol, ethanol and isopropanol; aromatic hydrocarbons such as toluene and xylene; ketones such as acetone and methyl ethyl ketone; and tetrahydrofuran and dioxane, and mixtures of the above.

After the core particles are coated with the coating liquid as mentioned above, the core particles are dried and heated, so that the coated silicone resin layer is hardened on the core particles, thus the carrier particles according to the present invention are prepared.

When drying the above coating liquid coated core particles, it is effective to add to the coating liquid as a drying acceleration agent a metal salt such as lead octylate, lead naphthenate, iron octylate, iron naphthenate, cobalt octylate, cobalt naphthenate, manganese octylate, manganese naphthenate, zinc octylate and zinc naphthenate, or an organic amine such as ethanol amine.

As a resin component of the toner to be used in combination with the carrier particles according to the present invention, homopolymers, copolymers and mixtures thereof of styrenes such as p-chlorostyrene; halogenated vinyl monomers such as vinyl chloride, vinyl bromide and vinyl fluoride; vinyl esters such as vinyl propionate, acetate, vinyl benzoate and vinyl butyrate; α-methylene fatty acid monocarboxylic acid esters such as methyl acrylate, ethyl acrylate, n-butyl acrylate, iso-butyl acrylate, dodecyl acrylate, n-octyl acrylate, 2-chloroethyl acrylate, phenyl acrylate, methyl α-chloroacylate, methyl methacrylate, ethyl methacrylate and butyl methacrylate; acrylonitrile, methacrylonitrile and acrylamide; vinyl ethers such as vinyl methyl ether, vinyl iso-butyl ether and vinyl ethyl ether; vinyl ketones such as vinyl methyl ketone, vinyl hexyl ketone and methyl iso-propenyl ketone; and N-vinyl compounds such as N-vinylpyrrole, N-vinyl-carbazole, N-vinylindole and N-vinylpyrrolidone.

In addition to the above resins, thermofusible non-vinyl-type resins such as rosin-modified phenol-formaldehyde resin, oil-modified epoxy resin, polyurethane resin, cellulose resin and polyether resin can be employed alone or in combination with the above mentioned vinyl-type resins as the resins for the toner.

As the coloring agents for use in the toner, the following can be employed: carbon black, Nigrosine dye, Aniline Blue, Calconyl Blue, Chrome Yellow, Ultramarine Yellow, Methylene Blue, Du Pont Oil Red, Quinoline Yellow, Methylene Blue Chloride, Phthalocyanine Blue, Malachilte Green Oxalate, Lamp Black, and Rose Bengale, and mixtures of the above. It is necessary that these pigments be contained in the toner particles in an effective amount for producing clear visible images.

As the materials for the core particles of the carrier particles according to the present invention, for example, non-metallic materials such as sand and glass, metals and alloys such as cobalt, iron, copper, nickel, zinc, aluminum, brass and bronze, and oxides thereof can be employed. In addition to the above, any materials which are employed as core materials in the conventional carrier particles can be employed.

It is preferable that the particle size of such core particles be in the range of from 50 μm to 1000 μm, more preferably in the range of from 100 μm to 500 μm.

Embodiments of the present invention will now be explained by referring to the following examples.

EXAMPLE 1

Preparation of Carrier Coating Liquid

A mixture of the following components was dispersed to prepare a carrier coating liquid:

| | Parts by Weight |
|---|---|
| Toluene | 100 |
| Silicone Varnish (KR-271 commercially available from Shin-etsu Silicone Co., Ltd.) | 100 |
| Carbon black (Ketjen Black EC commercially available from Lion Akzo Co., Ltd.) | 0.4 |
| Dibutyl tin dilaurate | 0.5 |

Preparation of Carrier Particles No. 1

The above carrier coating liquid and 1000 parts of iron powder having an average particle size of 100 μm were mixed in a fluidized bed of a fluidized granulation dryer apparatus. The mixture was then dried in the atmosphere at 90° C., followed by allowing the mixture to stand in an electric heating furnace at 200° C. for 30 minutes, so that the silicone resin was hardened, whereby carrier particles No. 1 according to the present invention were prepared.

Preparation of Toner

A toner for use with the above prepared carrier particles No. 1 was prepared as follows:

A mixture of the following components was kneaded under application of heat at a temperature of 160° C. by a roll mill:

| | Parts by Weight |
|---|---|
| Styrene-n-butylmethacrylate copolymer (commercially available under the name of Himer SBM 73 from Sanyo Chemical Industries, Ltd.) | 100 |
| Nigrosine dye (commercially available under the name of Spirit Black SB from Oriental Chemical Industrial Ltd.) | 1 |
| Carbon black | 10 |

After cooling the kneaded mixture, it was roughly crushed by a speed mill. Thereafter the mixture was finely divided by a jet mill and was then subjected to classification by a pneumatic classifier, whereby a toner having an average particle size of 6 μm was prepared.

Preparation of Two-Component Dry-Type Developer No. 1

100 parts of the carrier particles No. 1 and 2.5 parts of the above prepared toner were mixed, whereby a two-component dry-type developer No. 1 was prepared.

The specific volume resistivity of the carrier particles was $1.2\times10^{10}$ Ωcm and the quantity of electric charge generated in the toner was 20 μC/g.

Image Formation Tests

Image formation tests were carried out by a commercially available copying machine, using the two-component dry-type developer No. 1. Copies with excellent image quality, with clear reproduction of line images, solid images and half-tone images, were obtained.

Comparative Example 1

Example 1 was repeated except that dibutyl tin dilaurate serving as an organic tin compound was eliminated from the composition of the carrier coating liquid, whereby comparative carrier particles No. 1 were prepared.

In the same manner as in Example 1, a comparative developer No. 1 was prepared by mixing with the toner particles prepared in Example 1.

The electric resistivity of the comparative developer No. 1 was $1.1\times10^{10}$ Ωcm and the quantity of electric charge generated in the toner particles was 3 μC/g.

Image formation tests were carried out in the same manner as in Example 1 using the comparative developer No. 1. The result was that images with considerable fogging were formed.

Comparative Example 2

Example 1 was repeated except that carbon black was eliminated from the composition of the carrier coating liquid, whereby comparative carrier particles No. 2 were prepared.

In the same manner as in Example 1, a comparative developer No. 1 was prepared by mixing with the toner particles prepared in Example 1.

The electric resistivity of the comparative developer No. 2 was $1.1\times10^{14}$ Ωcm and the quantity of electric charge generated in the toner particles was 30 μC/g.

Image formation tests were carried out in the same manner as in Example 1 using the comparative developer No. 2. The result was that images free from fogging were formed, but the reproduction of half-tone images was considerably pocr due to the edge effects.

The comparison between Example 1 and Comparative Example 1 indicates that when carbon black was added in order to improve the reproduction of line images and halftone images, the quantity of electric charges generated in the toner particles decreased, but the addition of the organic tin catalyst increased the quantity of electric charges in the toner particles, so that proper images were formed.

In Comparative Example 2, since the electric resistance of the carrier particles was so high that the quantity of electric charge generated in the toner particles was large and the edge effects were found to be enhanced.

In short, the quantity of electric charges generated in the toner particles increased as the amount of the organic tin compound increased, while the quantity of electric charges generated in the toner particles decreased as the amount of carbon black increased since the electric resistivity of the carrier layer decreased.

FIG. 1 is a graph showing the relationship between the the quantity of carbon added as an electroconductive material and the quantity of electric charge of a developer of the type explained in Example 1.

Figure 2:
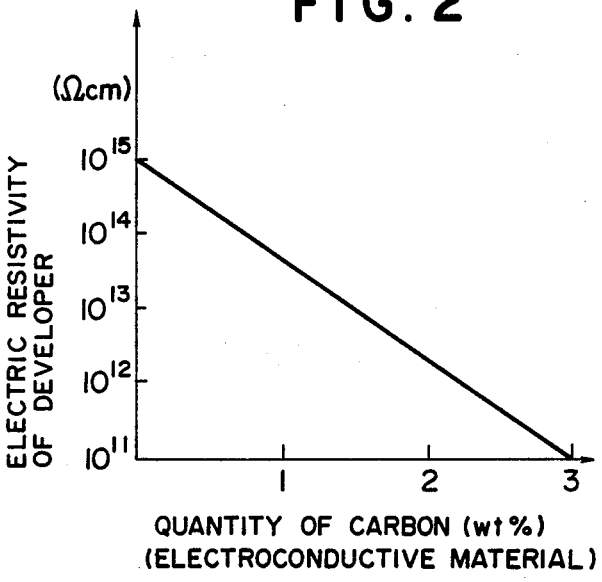
FIG. 2 is a graph showing the relationship between the quantity of carbon added as an electroconductive material and the electric resistivity of the developer.

FIG. 2 is a graph showing the relationship between the quantity of carbon added as an electroconductive material and the electric resistivity of the developer.

Figure 3:
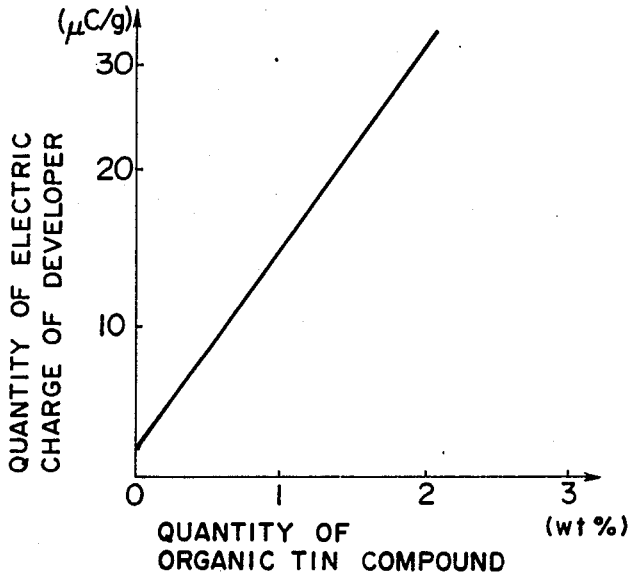
FIG. 3 is a graph showing the relationship between the quantity of an organic tin compound and the quantity of electric charge of the developer.

FIG. 3 is a graph showing the relationship between the quantity of the organic tin compound (dibutyl tin dilaurate) and the quantity of electric charge of the developer.

Figure 4:
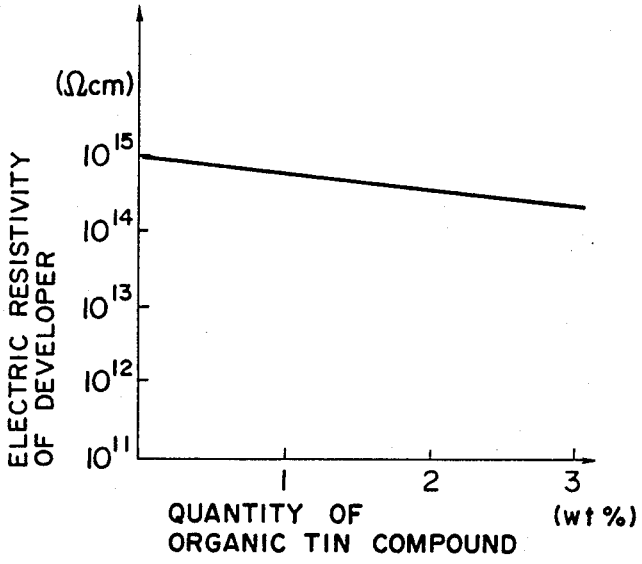
FIG. 4 is a graph showing the relationship between the quantity of the organic tin catalyst and the electric resistivity of the developer.

FIG. 4 is a graph showning the relationship between the quantity of the organic tin compound and the electric resistivity of the developer.

As can be seen from the above graphs, when the quantity of carbon increased, both the quantity of electric charges and the electric resistivity of the developer decreased. In contrast to this, when the amount of the organic tin compound increased, the quantity of electric charge of the developer increased, but the electric resistivity of the developer did not much increase. Therefore, the electric resistivity of the developer can be adjusted as desired by changing the quantity of the electroconductive material and the quantity of electric charge of the developer can also be changed by changing the quantity of the organic tin compound, whereby the quantity of electric charges and the electric resistivity of the developer can be obtained as desired.

EXAMPLE 2

Example 1 was repeated except that dibutyl tin dilaurate serving as organic tin compound and carbon black serving as the electroconductive material were respectively replaced by the previously mentioned organic tin compound No. 1 and titanium oxide, whereby carrier particles No. 2 according to the present invention were prepared and a developer No. 2 was also prepared by mixing the carrier particles No. 2 with the toner prepared in Example 1.

EXAMPLE 3

Example 1 was repeated except that dibutyl tin dilaurate serving as organic tin compound and carbon black serving as the electroconductive material were respectively replaced by the previously mentioned organic tin compound No. 5 and silicon carbide, whereby carrier particles No. 3 according to the present invention were prepared and a developer No. 3 was also prepared by mixing the carrier particles No. 3 with the toner prepared in Example 1.

EXAMPLE 4

Example 1 was repeated except that dibutyl tin dilaurate serving as organic tin compound and carbon black serving as the electroconductive material were respectively replaced by the previously mentioned organic tin compound No. 8 and iron oxide, whereby carrier particles No. 4 according to the present invention were prepared and a developer No. 4 was also prepared by mixing the carrier particles No. 4 with the toner prepared in Example 1.

With respect to each of the above developers No. 2 through No. 4, the relationship between the quantity of the electroconductive material and the quantity of electric charges of each developer, the relationship between the quantity of the electroconductive material and the electric resistivity of the developer, the relationship between the quantity of the organic tin compound and the quantity of electric charges of each developer, and the relationship between the quantity of the organic tin compound and the electric resistivity of the developer were investigated. Almost the same results were obtained as those shown in FIGS. 1 through 4.

(1) According to the present invention, since the carrier coating layer comprises a silicone resin having a low surface energy, toner particles hardly adhere and fix to the carrier particles.

(2) Generally silicone resin has a shortcoming of easily wearing away. However, in the present invention, an electroconductive material is dispersed in the silicone resin and the electroconductive material works as a filler in the silicone resin, so that the silicone resin does not easily wear away.

(3) The silicone resin, prior to the hardening, includes silanol groups (—SiOH) and is reactive with inorganic materials. Therefore, the silicone resin is capable of closely adhering to the core material of carrier particles (for instance, iron and ferrite) without particular treatment. Tetrafluoroethylene is known as a material having low surface energy, which is similar to silicone resin in this sense. However, unlike the silicone resin, tetrafluoroethylene does not adhere to the core material of the carrier particles. Therefore, it is necessary to treat the core material, for instance, with a coupling agent or a pre-coating material, prior to the coating with tetrafluoroethyelene or to subject the core material to a complex pretreatment for assuring close adhesion of tetrafluoroethylene to the core material.

(4) Since the silicone resin, prior to the hardening, includes silanol groups (—SiOH), electroconductive inorganic materials can be well dispersed in the silicone resin. Further, since it has methyl groups, electroconductive organic materials such as carbon black can be well dispersed in the silicone resin.

(5) When silanol groups (—SiOH) undergoes a condensation reaction by the presence of an organic tin compound, the quantity of electric charge generated in the toner particles can be adjusted as desired by changing the amount of the organic tin compound. The exact mechanism of the organic tin compound having an effect on the quantity of electric charge generated in the toner particles is unknown. However, tin is detected in the carrier coating layer after the silicone resin is hardened.

(6) The resistivity of the coating layer of the carrier particles can be adjusted by changing the quantity of an electroconductive material and the quantity of electric charge generated in the toner particles can be adjusted by changing the quantity of an organic tin compound. Therefore, the resistivity of the carrier particles can be adjusted to the same extent as that of uncoated carrier particles, although the carrier particles according to the present invention are coated with the silicone resin having high electric resistivity.

What is claimed is:

1. Carrier particles for use in a two-component dry-type developer for developing latent electrostatic images, comprising: a core particle and a silicone resin layer coated on said core particle, said silicone resin layer comprising a silicone resin, an organic tin compound and finely-divided electroconductive particles.

2. The carrier particles as claimed in claim 1, wherein said organic tin compound is represented by the formula: $R_2{}^1Sn(OCOR^2)_2$ wherein $R^1$ and $R^2$ each represent an alkyl group having 1 to 10 carbon atoms.

3. The carrier particles as claimed in claim 1, wherein said organic tin compound is represented by the formula: $Sn(OCOR)_4$ wherein R represents an alkyl group having 1 to 10 carbon atoms.

4. The carrier particles as claimed in claim 1, wherein said organic tin compound is selected from the group consisting of:

$$(H_3C(CH_2)_3)_2Sn(OOC(CH_2)_{10}CH_3)_2 \qquad \text{No. 1}$$

-continued

No. 2

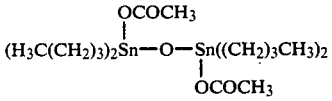

No. 3

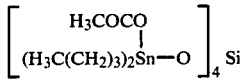

No. 4

$(CH_3(CH_2)_3)_2Sn(OCH_3)_2$

No. 5

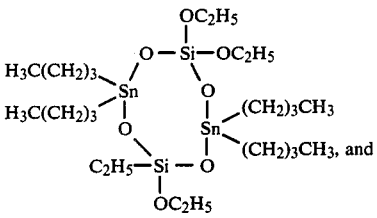

No. 6

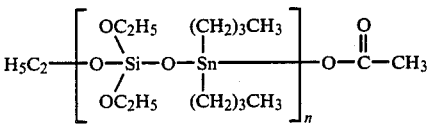

5. The carrier particles as claimed in claim 1, wherein said finely-divided electroconductive particles are selected from the group consisting of carbon black, a boride, a carbide, a nitride, an oxide and a silicide.

6. The carrier particles as claimed in claim 1, wherein said finely-divided electroconductive particles have a particle size of 1 μm or less.

7. The carrier particles as claimed in claim 1, wherein the amount of said finely-divided electronductive particles is in the range of 1 wt. % to 50 wt. % to the entire weight of the carrier coating layer.

8. The carrier particles as claimed in claim 1, wherein the particle size of said core particle is in the range of from 50 μm to 1000 μm.

9. The carrier particles as claimed in claim 5, wherein said boride is selected from the group consisting of chromium boride, hafnium boride, molybdenum boride, niobium boride, tantalum boride, titanium boride and zirconium boride.

10. The carrier particles as claimed in claim 5, wherein said carbide is selected from the group consisting of boron carbide, hafnium carbide, molybdenum carbide, niobium carbide, silicon carbide, thallium carbide, titanium carbide, uranium carbide, vanadium carbide, tungsten carbide and zirconium carbide.

11. The carrier particles as claimed in claim 5, wherein said nitride is selected from the group consisting of boron nitride, niobium nitride, thallium nitride, titanium nitride, vanadium nitride and zirconium nitride.

12. The carrier particles as claimed in claim 5, wherein said oxide is selected from the group consisting of chromium oxide, lead oxide, tin oxide, vanadium oxide, molybdenum oxide, bismuth oxide, iron oxide ($Fe_3O_4$), niobium oxide, osmium oxide, platinum oxide, rhenium oxide, ruthenium oxide, titanium oxide and tungsten oxide.

13. The carrier particles as claimed in claim 5, wherein said silicide is selected from the group consisting of molybdenum silicide, niobium silicide, thallium silicide, titanium silicide, vanadium silicide and tungsten silicide.

* * * * *